US008413601B2

(12) United States Patent
Pei

(10) Patent No.: US 8,413,601 B2
(45) Date of Patent: Apr. 9, 2013

(54) COATING DEVICE

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 492 days.

(21) Appl. No.: 12/723,676

(22) Filed: Mar. 14, 2010

(65) Prior Publication Data

US 2011/0017136 A1 Jan. 27, 2011

(30) Foreign Application Priority Data

Jul. 21, 2009 (CN) ..... 2009 1 0304589

(51) Int. Cl.
*B05C 13/00* (2006.01)

(52) U.S. Cl.
USPC ..... 118/64; 118/326; 118/500

(58) Field of Classification Search ..... 118/64, 118/326, 500; 198/580; 414/562; 29/429, 29/700
See application file for complete search history.

(56) References Cited

U.S. PATENT DOCUMENTS 4,515,264 A * 5/1985 Sticht ..... 198/375
6,851,912 B1 * 2/2005 Zahn ..... 414/404
8,056,200 B2 * 11/2011 Hesse et al. ..... 29/33 P

* cited by examiner

*Primary Examiner* — Laura Edwards
(74) *Attorney, Agent, or Firm* — Altis Law Group, Inc.

(57) ABSTRACT

A coating device includes a table, a number of coating housings, a carrier, a number of conveyors, and a number of turntables. The coating housings are separately mounted on the table, and each including a hatch formed thereon. The hatches of all the coating housings face towards a same direction. The carrier are used for carrying one or more products to be coated. The conveyors are distributed on the table around each of the coating housing, and respectively extend into the inside of the coating housing through the hatch for delivering the carrier into the coating housings in turn. The turntables are installed between every two adjacent conveyors for transporting the carrier from a preceding conveyor to a succeeding conveyor according to a predefined route, respectively.

7 Claims, 4 Drawing Sheets

COATING DEVICE

BACKGROUND

1. Technical Field

The disclosure relates to a coating device.

2. Description of Related Art

Coating is widely used in industry to ameliorate the surface characteristics of products. Multiple layers coated on a product can attain various surface properties to the product. Generally, a coating workflow includes a number of workstations where a corresponding number of coating equipments is equipped. The coating equipments in the coating workflow are positioned one after another along a moving belt, which is used for transporting work pieces between the coating equipments. Accordingly, each of the coating equipment is equipped with an entrance door for allowing the products to enter for a coating treatment, and an exit door for allowing the products to exit after the coating treatment. When the coating treatment of a work piece is finished, the exit door of the coating equipment is opened for allowing the work piece to exit from, simultaneously, the entrance doors of the successive coating equipment are also opened, so as to be ready to receive the work piece. The gases and vaporized coating materials in the two pieces of coating equipment interchange and contaminate each other, which will thereby reduce the coating quality of the work piece.

What is needed is to provide a coating device which can overcome the problems mentioned above.

DETAILED DESCRIPTION

Figure 1:
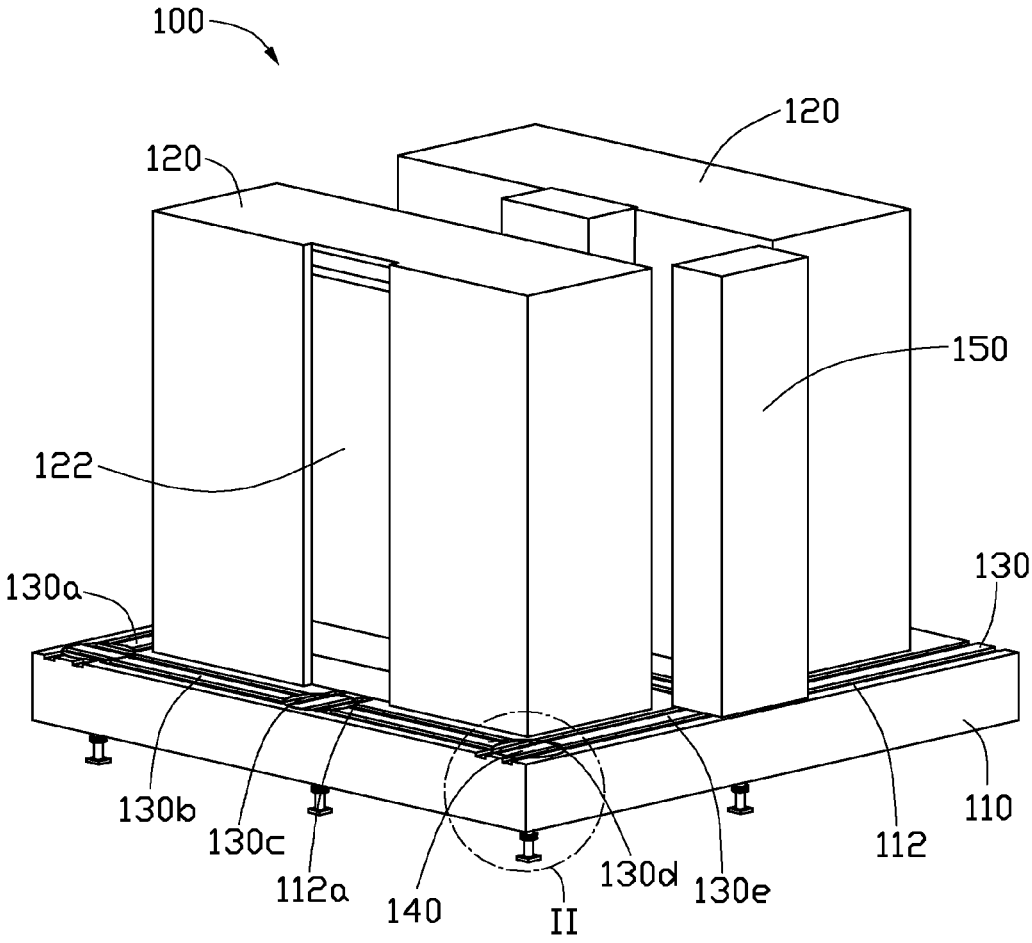
FIG. 1 is an isometric view of a coating device according to an exemplary embodiment.
Figure 2:
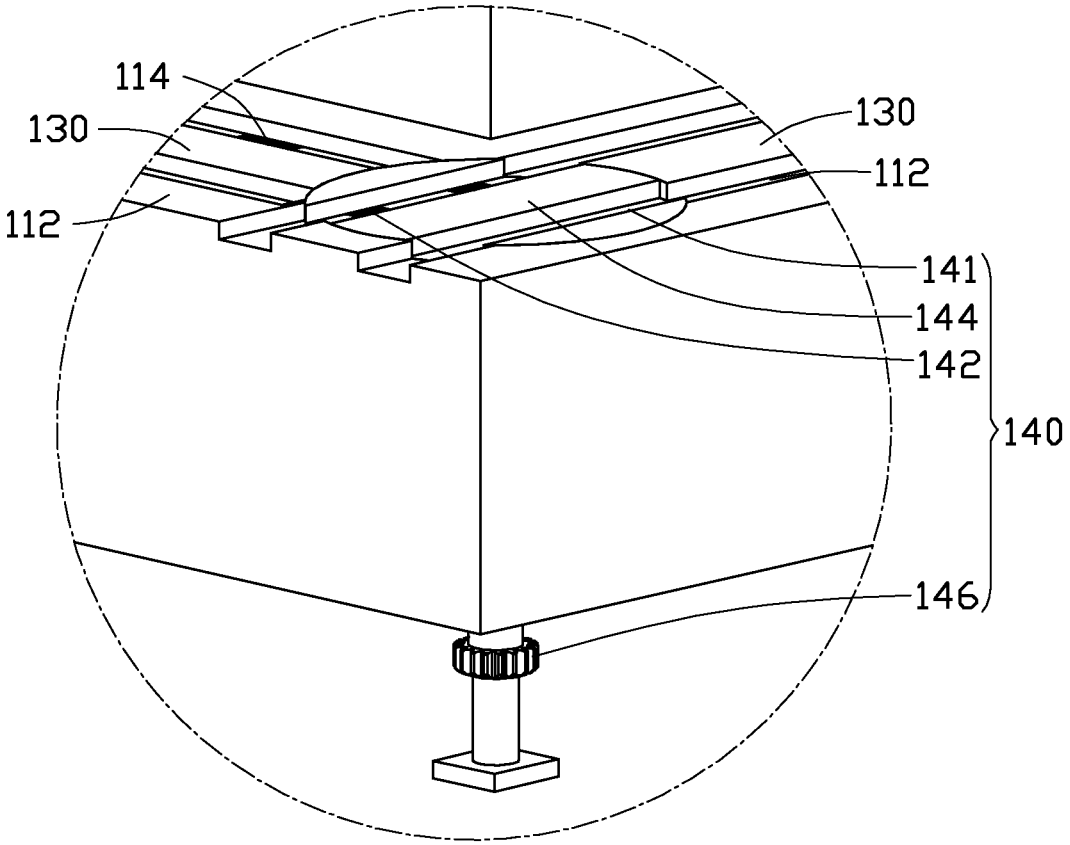
FIG. 2 is a partially detailed isometric view of the coating device of FIG. 1.

Referring to FIGS. 1 and 2, a coating device 100 of an exemplary embodiment is shown. The coating device 100 includes a table 110, a plurality of coating housings 120, a plurality of conveyors 130, a plurality of turntables 140, and a carrier 150. The coating housings 120, in which each includes a hatch 122 and are spaced apart from each other, are mounted on the table 110. All of the hatches 122 face a same direction. The conveyors 130 are distributed on the table 110, and surrounding each of the coating housings 120 and extending to the hatch 122 of the coating housing 120. The turntables 140 are correspondingly installed between every two adjacent conveyors 130. The carrier 150 is held by the conveyors 130, and can be delivered through the hatches 122 into the coating housings 120, thereby allowing for coating of one or more products that are loaded on the carrier 150.

The table 110 defines a flow line 112 on an upper surface thereof, surrounding each of the coating housings 120. The flow line 112 includes a plurality of branches 112*a* extending into the interior of the coating housings 120 through the hatches 122. The table 110 further includes a plurality of location detectors 114 distributed along the flow line 112 which are used for sending signals to a controlling system (not shown) when the carrier 150 passes the location detectors 114. The controlling system controls the conveyors 130 and the turntable 140 to configure cooperatively a route assigned for the carrier 150 based on the signals generated by the location detectors 114. Each of the location detectors 114 is assigned with an identity number for representing the corresponding location themselves. The identity numbers of the detectors 114 are carried by the signals to the controlling system. The controlling system identifies the detector 114, and determines the location of the carrier 150 according to the signals, and accordingly the controlling system then sends commands to control the conveyors 130 and the turntables 140, so that the carrier 150 can be delivered by the conveyors 130 and the turntables 140 to a target coating housing 120.

The controlling system is used for storing the data of the conveyors 130 and the turntables 140, receiving a predefined program for configuring a predefined route for the carrier 150, and controlling the conveyors 130 and the turntables 140 to deliver the carrier 150 according to the predefined route. In the present disclosure, the controlling system is also a programmable system and includes, for example, a processing unit, a memory unit, and a user interface. The user interface is configured for receiving and modifying the predefined program. The memory unit is configured for storing the data on the coating device 100, including for example the identity numbers of the location detectors 114 and other identifiable symbols of the conveyor 130 and the turntable 140 and so on, as well as the predefined program. The processing unit is configured for controlling the conveyors 130 and the turntables 140 to carry out a predefined route according to the predefined program stored in the memory unit.

Each of the coating housings 120 is used for coating a unique layer of film on the products. The hatches 122 of the coating housings 120 are opened automatically when the carrier 150 arrives.

Figure 3:
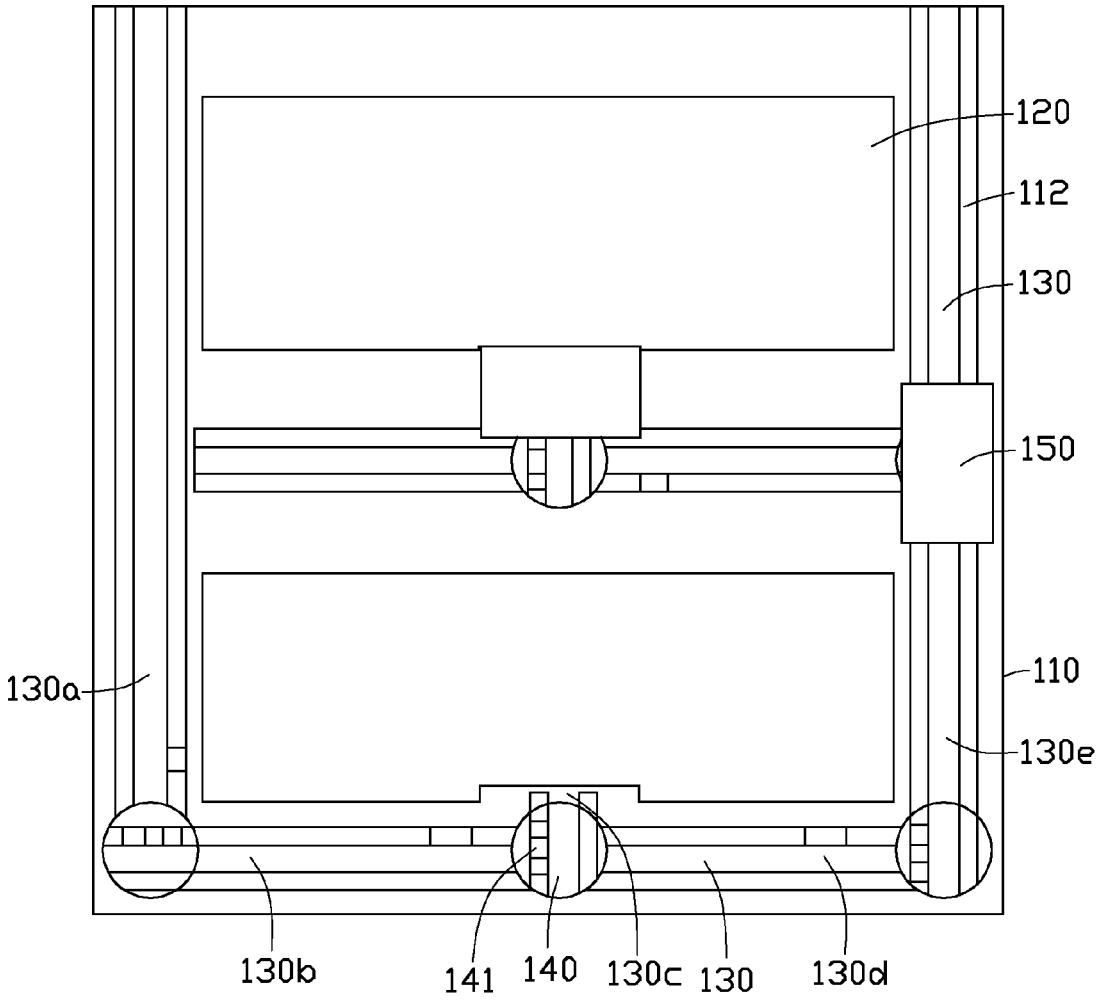
FIG. 3 is a top view of the coating device of FIG. 1.

Referring to FIG. 3, the conveyors 130 are mounted on the surface of the table 110 along the flow line 112, respectively. Each of the conveyors 130 includes, for example, a servo unit (not shown) controllably connected to the controlling system to receive commands from the processing unit, and a belt (not shown) capable of being operated by the servo unit according to the commands. To further illustrate and describe the distributive pattern of the conveyors 130 more explicitly, five conveyors 130, respectively indicated as first to fifth conveyors and correspondingly denoted by 130*a*~130*e* for facilitating more detailed identifications, are employed in the present embodiment. The first to fifth conveyors 130*a*~130*e* are mounted on the table 110 along the flow line 112 surrounding one of the coating housings 120. The first, third and fifth conveyors 130*a*, 130*c* and 130*e* each are parallel to the other two. The second conveyor 130*b* is positioned perpendicularly between the two adjacent ends of the first and third conveyors 130*a* and 130*c*. The fourth conveyor 130*d* is, parallel with the second conveyor 130*b* and perpendicularly positioned between the two adjacent ends of the third and fifth conveyors 130*c* and 130*e*. The third conveyor 130*c* extends inside the coating housing 120 through the hatch 122 of the coating housing 120 along one of the branches 112*a*.

The turntables 140 are each installed between the conveyors 130, for transporting the carrier 150 from one conveyor 130 to another, respectively. Each of the turntables 140 is equipped with a sensor 142, a transmission servomechanism 144, and a rotation servomechanism 146. The sensor 142 is located on the turntable 140 for detecting whether the carrier 150 is loaded on the turntable 140. The transmission servomechanism 144 is mounted on the turntable 140 for transporting the carrier 150 from the turntable 140 to a following conveyor 130. The rotation servomechanism 146 is mounted below the turntable 140, for rotating the turntable 140 to align with the conveyor 130, so that the transmission servomechanism 144 is able to transport the carrier 150 from one conveyor 130 to another. The sensor 142, the transmission servomechanism 144, and the rotation servomechanism 146 are controllably communicated with the controlling system. The sensor 142, the transmission servomechanism 144, and the rotation servomechanism 146 are each assigned with an identity number for representing their locations. The identity numbers are identifiable to the controlling system. Upon the sensor 142 of a turntable 140 detecting that the carrier 150 is being loaded on the turntable 140, the sensor 142 sends a signal carrying the identity number to the processing unit of the controlling system. The processing unit analyzes the signal, identifies the sensor 142 and sends a command accordingly to drive the rotation servomechanism 146 of the turntable 140 to rotate, thereby making the turntable 140 align with the next conveyor 130 according to the predefined route.

Figure 4:
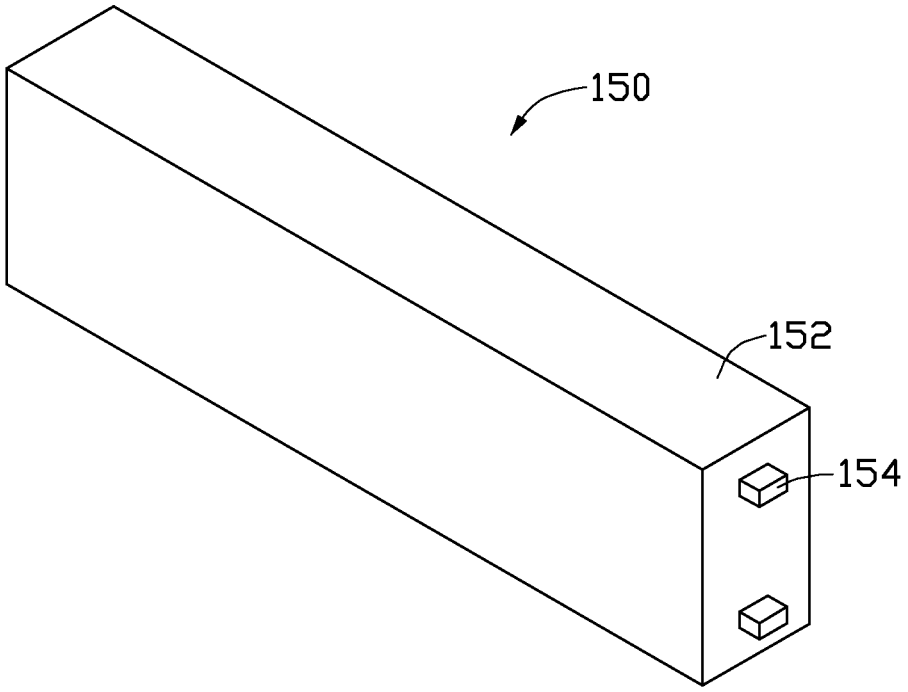
FIG. 4 is an isometric view of a carrier of the coating device of FIG. 1.

Referring to FIG. 4, the carrier 150 is loaded on the conveyors 130. The carrier 150 includes a main body 152 for supporting products thereon, and two legs 154 mounted on a bottom surface of the main body 154 for maintaining the stability of the carrier 150.

In use, products (not shown) are loaded on the carrier 150. The conveyors 130 and the turntables 140 are controlled by the controlling system according to a predefined route for delivering the carrier 150 to a target coating housing 120. In detail, when the coating device 100 is operated, the processing unit runs the program stored in the memory unit to present a predefined route, and accordingly the processing unit of the controlling system sends commands to the conveyors 130 to transport the carrier 150 according to the predefined route. When the carrier 150 passes a location detector 114, the location detector 114 sends a signal carrying the identity number of the location detector 114 to the processing unit. The processing unit analyzes the signal, identifies the location of the carrier 150 and correspondingly controls a next turntable 140 in the predefined route to align with a preceding conveyor 130 to receive the carrier 150 from the preceding conveyor 130. When the carrier 150 is loaded on the turntable 140, the sensor 142 of the turntable 140 sends a signal carrying the identity number of the sensor 142 to the processing unit. The processing unit correspondingly controls the rotation servomechanism 146 of the turntable 140 to rotate the turntable 140 to align with a next conveyor 130 of the predefined route. The processing unit successively controls the transmission servomechanism 144 to transport the carrier 150 from the turntable 140 to the next conveyor 130. As such, the carrier 150 is sent into a target coating housing 120 by means of the conveyors 130 and the turntables 140 successfully. When the coating treatment inside the target coating housing 120 is finished, the carrier 150 is transported into another target coating housing 120 for performing another coating treatment.

In the present disclosure, the coating housings 120 are isolated from each other, and the hatches 122 of the coating housings 120 are positioned far away and isolated from each other as well, thereby preventing the gases and evaporated materials inside the coating housings 120 from contaminating each other, and accordingly improving the coating qualities of the products.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A coating device, comprising:

a table;

a plurality of coating housings separately mounted on the table and each used for coating a unique layer of film on one or more products, each of the coating housings comprising a hatch formed thereon, and the hatches of all the coating housings facing a same direction;

a carrier for carrying the products to be coated;

a plurality of conveyors distributed on the table around each of the coating housings, some of the conveyors respectively extending into the insides of the coating housings through the hatches, and the plurality of conveyors configured for delivering the carrier into the coating housings in turn through the hatches;

a plurality of turntables installed between every two adjacent conveyors, respectively, and configured for transporting the carrier from a preceding conveyor to a succeeding conveyor according to a predefined route; and a controlling system for controlling the conveyors and the turntables to deliver the carrier to each of the coating housings.

2. The coating device of claim 1, wherein the table has an upper surface and defines a flow line on the upper surface; the flow line surrounds each of the coating housings and comprises a plurality of branches extending to the hatches of the coating housing; and the conveyors are mounted on the upper surface of the table along the flow line.

3. The coating device of claim 2, wherein the table further comprises a plurality of location detectors distributed along the flow line for sending one or more signals to the controlling system when the carrier passes the location detectors, and the controlling system controls the conveyors and the turntables according to the one or more signals sent from the location detectors.

4. The coating device of claim 3, wherein each of the detectors comprises an identity number representing the location themselves, and the identity number is carried by the signals sent to the controlling system; and the controlling system is thereby able to identify the location of the carrier according to the signals and send commands to control the conveyors and the turntables.

5. The coating device of claim 4, wherein each of the turntables is equipped with a sensor located on the turntable, a transmission servomechanism mounted on the turntable, and a rotation servomechanism mounted below the turntable; the sensor is configured for detecting whether the carrier is loaded on the turntable, and the sensor sends a signal upon detection of the carrier on the turntable; the transmission servomechanism is configured for transporting the carrier from the turntable to the following conveyor in the predefined route; the rotation servomechanism is configured for rotating the turntable to align with the following conveyor; and the sensor, the transmission servomechanism, and the rotation servomechanism are controllably communicated with the controlling system.

6. The coating device of claim 5, wherein the carrier comprises a main body for supporting one or more products thereon, and two legs mounted on a bottom surface of the main body.

7. A coating device, comprising:

a table;

a plurality of coating housings separately mounted on the table and each usable for coating a unique layer of film on one or more products, each of the coating housings comprising a hatch formed thereon, and the hatches of all the coating housings facing a same direction;

a carrier for carrying the one or more products to be coated;

a plurality of conveyors distributed on the table around the coating housings, some of the conveyors respectively extending into the insides of the coating housings through the hatches, and the conveyors configured for delivering the carrier into a plurality of the plurality of coating housings in turn through the corresponding hatches according to an assigned predefined route;

a plurality of turntables each installed between two respective adjacent conveyors or between three respective adjacent conveyors, each turntable configured for transporting the carrier from a preceding conveyor to a succeeding conveyor as required; and a controlling system for controlling the conveyors and the turntables to deliver the carrier to the plurality of the plurality of coating housings according to the assigned predefined route.

* * * * *